US008295750B2

(12) United States Patent
Yamana

(10) Patent No.: US 8,295,750 B2
(45) Date of Patent: Oct. 23, 2012

(54) FIXING APPARATUS AND IMAGE FORMING APPARATUS EQUIPPED THEREWITH

(75) Inventor: Shinji Yamana, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 750 days.

(21) Appl. No.: 12/389,410

(22) Filed: Feb. 20, 2009

(65) Prior Publication Data

US 2009/0214275 A1 Aug. 27, 2009

(30) Foreign Application Priority Data

Feb. 21, 2008 (JP) ..... 2008-040676
Dec. 27, 2008 (JP) ..... 2008-335573

(51) Int. Cl.
*G03G 15/20* (2006.01)

(52) U.S. Cl. ..... 399/328; 399/69

(58) Field of Classification Search ..... 399/328, 399/329, 330, 333, 69, 70
See application file for complete search history.

(56) References Cited

U.S. PATENT DOCUMENTS 7,319,839 B2 1/2008 Ishii et al.
2007/0189817 A1 8/2007 Kagawa
2007/0196120 A1 8/2007 Maeda
2007/0217807 A1 9/2007 Maeda et al.
2007/0217808 A1 9/2007 Maeda
2007/0217837 A1* 9/2007 Yamana et al. ..... 399/328
2007/0248389 A1* 10/2007 Asakura et al. ..... 399/328

FOREIGN PATENT DOCUMENTS

JP 2003-098876 4/2003
JP 2004-198659 7/2004
JP 2005-189427 7/2005
JP 2006-011061 1/2006
JP 2007-212896 8/2007
JP 2007-219450 8/2007
JP 2007-248655 9/2007
JP 2007-248656 9/2007
JP 2007-248725 9/2007
JP 2008-040268 2/2008

* cited by examiner

*Primary Examiner* — Hoang Ngo
(74) *Attorney, Agent, or Firm* — Renner, Otto, Boisselle & Sklar, LLP

(57) ABSTRACT

A fixing apparatus includes a pair of fixing sections pressed against each other and including a fixing roller having a heater lamp incorporated therein and a pressure roller; an endless belt for heating the surface of the fixing roller by bringing a heating nip portion into contact with the fixing roller; and a plurality of support rollers supporting the endless belt therearound so as to give tension, and each having a heater lamp incorporated therein. The endless belt has a thickness of 0.08 mm or more and 0.14 mm or less, and the heating nip portion is formed in an angular range of 50° or more and 90° or less around a center axis of the fixing roller.

6 Claims, 7 Drawing Sheets

FIXING APPARATUS AND IMAGE FORMING APPARATUS EQUIPPED THEREWITH

CROSS-REFERENCE TO RELATED APPLICATION

This application claims priority to Japanese Patent Application Nos. 2008-040676 and 2008-335573, which were filed on Feb. 21, 2008 and Dec. 27, 2008, the contents of which are incorporated herein by reference in its entirety.

BACKGROUND OF THE INVENTION

1. Field of the Invention

The present invention relates to a fixing apparatus for fixing a toner image onto a recording material, and an image forming apparatus having the same.

2. Description of the Related Art

As a fixing apparatus for use in an electrophotographic image forming apparatus such as a copying machine and a printer, a fixing apparatus of heat-roller fixing type has been in wide use. The heat-roller fixing-type fixing apparatus includes a pair of rollers, to be more specific, a fixing roller and a pressure roller, that are brought into contact with each other under pressure. By means of a heating section composed for example of a halogen heater, which is placed in each of or one of the pair of rollers interiorly thereof, the pair of rollers are heated to a predetermined fixing temperature. With the pair of rollers kept in a heated state, such as a recording sheet, which is a recording material having formed thereon an unfixed toner image, is fed to a region where the pair of rollers make pressure-contact with each other, namely a so-called fixing nip region. Upon the recording sheet passing through the fixing nip region at certain heating time and a fixing temperature, the toner image is fixed into place under application of heat and pressure.

Moreover, a fixing apparatus for use in a color image forming apparatus generally employs an elastic roller constructed by forming an elastic layer made for example of silicone rubber on a surface layer of the fixing roller. By designing the fixing roller as an elastic roller, it is possible for the surface of the fixing roller to become elastically deformed so as to conform to irregularities of the unfixed toner image, wherefore the fixing roller makes contact with the toner image so as to cover the surface of the toner image. This makes it possible to perform satisfactory thermal fixation on the unfixed color toner image that is larger in toner adherent amount than a monochromatic toner image. Moreover, by virtue of a deflection-releasing effect exerted by the elastic layer in the fixing nip region, it is possible to provide enhanced mold releasability for a color toner that is more susceptible to occurrence of offset than a monochromatic toner. Further, since the fixing nip region is convexly curved in a radially-outward direction so as to define a so-called reverse nip configuration, it is possible to attain higher paper-stripping capability. That is, a paper stripping action can be produced without using a stripping portion such as a stripping pawl (self-stripping action), wherefore image imperfection caused by the provision of the stripping portion can be eliminated.

In such a color image forming apparatus, when the process speed is increased, the heating time is insufficient if the used fixing nip width is kept comparable with the width used during low-speed operation. Accordingly, it is necessary to increase the fixing nip width. One available method of increasing the fixing nip width is to increase the diameter of the fixing roller. Another method is to increase the thickness of the elastic layer to increase the amount of elastic deformation. However, if the diameter of the fixing roller is increased, the curvature of the fixing roller is reduced. Consequently, if only repulsion of the elastic layer is used, the recording material is not easily peeled off from the fixing roller. As a result, the releasing performance of the recording material deteriorates.

Further, increasing the thickness of the elastic layer causes the following problem. In the fixing roller having the elastic layer, the elastic layer in itself exhibits extremely low thermal conductivity. Therefore, an increase in the thickness of the elastic layer may lead, in a case of providing a heating section within the fixing roller, to further reduction in heat transfer efficiency. Furthermore, if the process speed is increased, heat taken away by the recording material which has passed through the nip region can not be compensated because heat transfer from the interior of the fixing roller slows down. Accordingly there is a possibility that the temperature of the fixing roller cannot stay close to a fixing temperature. Thereby, a surface temperature of the fixing roller can not be maintained, and as a result, the fixing failure is generated.

In order to solve such problems, a fixing apparatus of the external heating type which brings into an external heating section with the surface of the fixing roller, is known. Especially, in recent years, a fixing apparatus of the external belt heating type has been proposed which uses an endless belt as an external heating section, which endless belt is heated to a temperature higher than the surface temperature of the fixing roller and is brought into abutment with the surface of the fixing roller.

One fixing apparatus of the above-described external belt heating type is disclosed, for example, in Japanese Unexamined Patent Publication JP-A 2004-198659, where a rotatable fixing roll for fixing an unfixed image formed on a recording material has a belt-like region on its surface, which belt-like region has a length in the direction of the outer periphery of the surface of the fixing roll and extends longitudinally and is heated from the outside by an external heating member.

Further, Japanese Unexamined Patent Publication JP-A 2005-189427 discloses a fixing apparatus having a fixing roller that is rotationally driven by an electric motor. The apparatus further includes support rollers that are rotationally driven by the fixing roller.

In this way, the fixing apparatus of the external belt heating type can directly supply heat to the surface of the fixing roller from which heat is removed by the recording material. This apparatus is adapted for high-speed color fixing applications where the fixing roller has a thickened elastic layer.

In the conventional fixing apparatuses of the external belt heating type as disclosed, for example, in JP-A 2004-198659 and JP-A 2005-189427, the amount of heat supplied to the fixing roller by the external heating means (i.e., the amount of heat flow) is not optimized sufficiently and so there is the problem that the warming-up time is not shortened sufficiently.

Furthermore, depending on the condition of the external belt, contact with a lateral motion-hindering member produces cracks in greatly stressed ends or poor rotation. In consequence, the surface temperature of the fixing roller may not be maintained stably.

SUMMARY OF THE INVENTION

The invention has been made in view of the foregoing problem. An object of the invention is to provide a fixing apparatus capable of shortening the warming-up time and maintaining a surface temperature of the fixing roller stably, and an image forming apparatus equipped therewith.

The invention provides a fixing apparatus comprising:

a pair of fixing sections pressed against each other and including a fixing roller having a first heat-generating portion incorporated therein, and a pressure roller;

an endless belt for heating a surface of the fixing roller by bringing a heating nip portion into contact with the fixing roller; and a plurality of support rollers supporting the endless belt therearound so as to give tension, and each having a second heat-generating portion incorporated therein, wherein the endless belt has a thickness of 0.08 mm or more and 0.14 mm or less, and the heating nip portion is formed in an angular range of 50° or more and 90° or less around a center axis of the fixing roller.

According to the invention, the fixing apparatus has a pair of fixing sections pressed against each other and including a fixing roller having a first heat-generating portion incorporated therein, and a pressure roller; an endless belt for heating a surface of the fixing roller by bringing a heating nip portion into contact with the fixing roller; and a plurality of support rollers supporting the endless belt therearound so as to give tension, and each having a second heat-generating portion incorporated therein, wherein the endless belt has a thickness of 0.08 mm or more and 0.14 mm or less. The endless belt has a thickness of 0.08 mm or more and 0.14 mm or less, so that ends of the endless belt can be prevented from being cracked. Furthermore, poor rotation of the endless belt can be prevented.

Further, the heating nip portion is formed in the angular range of 50° or more and 90° or less around the center axis of the fixing roller. Consequently, the amount of heat flow from the endless belt to the fixing roller can be controlled appropriately. Therefore, a surface temperature of the fixing roller can be made to reach a second preset temperature before the surface temperature of the endless belt reaches a first preset temperature. Accordingly, the time taken for the fixing roller to reach the second preset temperature, e.g., warming-up time, can be shortened.

Therefore, the warming-up time of the fixing apparatus of the invention can be shortened. Furthermore, the surface temperature of the fixing roller can be maintained stably.

Further, in the invention, it is preferable that each of the support rollers has a support roller body in a form of a hollow cylinder, and longitudinal both end portions of the support roller body are made thinner than a longitudinal intermediate portion thereof.

According to the invention, each of the support rollers has a support roller body in the form of a hollow cylinder, and the longitudinal both end portions of the in the support roller body are made thinner than the longitudinal intermediate portion thereof.

Consequently, the temperatures of the longitudinal both end portions of each of the support rollers can be prevented from decreasing due to insufficient heating by the second heat-generating portions or due to transfer of heat to bearing portions mounted at the opposite ends. Temperature can be made uniform axially. As a result, the surface of the fixing roller can be heated uniformly. Therefore, during warming-up, the surface temperatures of the longitudinal both end portions of the fixing roller can be prevented from falling; otherwise, poor fixing would occur at the opposite ends of the paper.

Further, in the invention, it is preferable that each of the second heat-generating portions produces an amount of heat of 3,000 W/m or less, and a total amount of heat generated by the second heat-generating portions is 1,700 W/m or more.

According to the invention, the amount of heat generated by each of the second heat-generating portions is preferably 3,000 W/m or less, and the total amount of heat generated by the second heat-generating portions is 1,700 W/m or more. Consequently, the warming-up time can be shortened. In addition, overheating of the second heat-generating portions can be prevented. Furthermore, the temperature gradient across each of the support rollers can be made milder, thus suppressing occurrence of an overshoot. Hence, inconveniences caused by such an overshoot can be suppressed.

Further, in the invention, it is preferable that the first heat-generating portion and each of the second heat-generating portions are controlled so that, before a surface temperature of the endless belt reaches a first preset temperature, a surface temperature of the fixing roller reaches a second preset temperature when the fixing roller, pressure roller, and the plurality of support rollers are rotating.

According to the invention, the first heat-generating portion and each of the second heat-generating portions are controlled so that, before a surface temperature of the endless belt reaches a first preset temperature, a surface temperature of the fixing roller reaches a second preset temperature when the fixing roller, pressure roller, and support rollers are rotating. In consequence, the time taken for the surface temperature of the fixing roller to reach the second preset temperature can be shortened.

Further, in the invention, it is preferable that the first heat-generating portion and each of the second heat-generating portions are controlled so that the surface temperature of the endless belt is equal to or higher than a same temperature as the surface temperature of the fixing roller and is not more than a temperature which is higher than the surface temperature of the fixing roller by 10° C. when the fixing roller, pressure roller, and support rollers have ceased to rotate.

According to the invention, the first heat-generating portion and each of the second heat-generating portions are controlled so that the surface temperature of the endless belt is equal to or higher than the surface temperature of the fixing roller and is not more than a temperature which is higher than the surface temperature of the fixing roller by 10° C. when the fixing roller, pressure roller, and support rollers have ceased to rotate.

Consequently, when the fixing roller, pressure roller, and support rollers have ceased to rotate, heat is supplied to the surface of the fixing roller via the endless belt while reducing the temperature variation across the surface of the fixing roller. Therefore, gloss nonuniformity in the final image can be prevented.

Further, in the invention, it is preferable that the endless belt and fixing roller are so configured to be brought into contact with each other when the fixing roller, pressure roller, and support rollers have ceased to rotate.

According to the invention, when the fixing roller, pressure roller, and support rollers have ceased to rotate, the endless belt and fixing roller are so configured to be brought into contact with each other. Consequently, when the fixing roller, pressure roller, and support rollers have ceased to rotate, it is not necessary to mount a separating mechanism for moving the endless belt away from the fixing roller. Consequently, the structure of the apparatus can be simplified and made compact.

Further, the invention also provides an image forming apparatus equipped with the above-described fixing apparatus.

According to the invention, the image forming apparatus has the fixing apparatus thus far described. The image forming apparatus can stably form high-quality images that are excellent in fixability.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
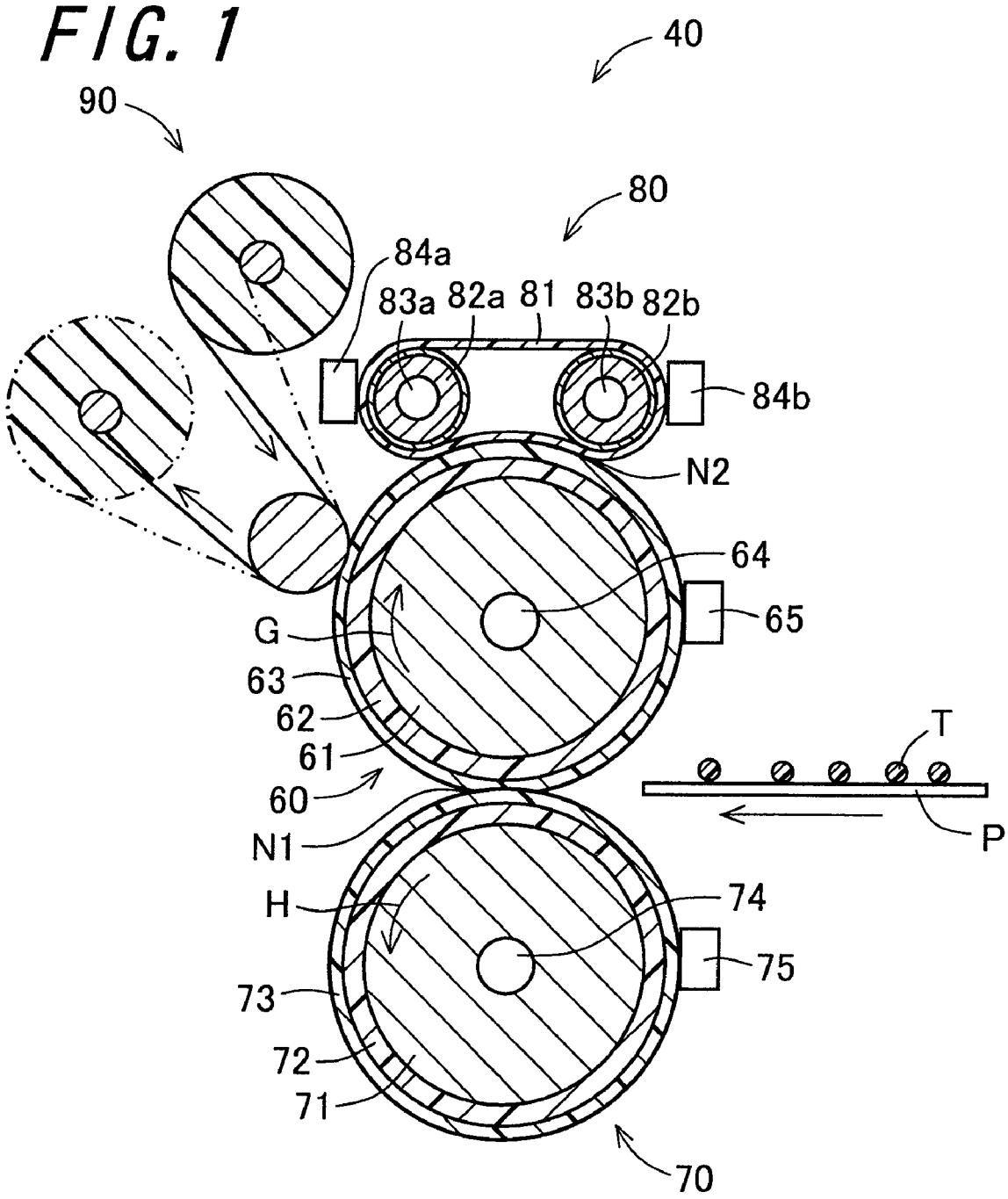
FIG. 1 is a sectional view showing the structure of a fixing apparatus according to one embodiment of the invention in simplified form.

The invention provides a fixing apparatus comprising a pair of fixing sections pressed against each other and including a fixing roller having a first heat-generating portion incorporated therein and a pressure roller; an endless belt for heating a surface of the fixing roller by bringing a heating nip portion into contact with the fixing roller; and a plurality of support rollers supporting the endless belt therearound so as to give tension, and each having a second heat-generating portion incorporated therein, wherein the endless belt has a thickness of 0.08 mm or more and 0.14 mm or less. Because the thickness of the endless belt is set to 0.08 mm or more and 0.14 mm or less in this way, the ends of the endless belt can be prevented from cracking. Furthermore, poor rotation of the endless belt can be prevented.

Further, the heating nip portion is formed in an angular range of 50° or more and 90° or less around a center axis of the fixing roller. Consequently, the amount of heat flow from the endless belt to the fixing roller can be controlled well. Therefore, the surface temperature of the fixing roller can be made to reach a second preset temperature before the surface temperature of the endless belt reaches a first preset temperature. Accordingly, the time taken for the fixing roller to reach the second preset temperature, e.g., warming-up time, can be shortened.

Therefore, the warming-up time of the fixing apparatus of the invention can be shortened. In addition, the surface temperature of the fixing roller can be maintained stably.

Now referring to the drawings, preferred embodiments of the invention are described below.

[Fixing Apparatus]

Figure 2:
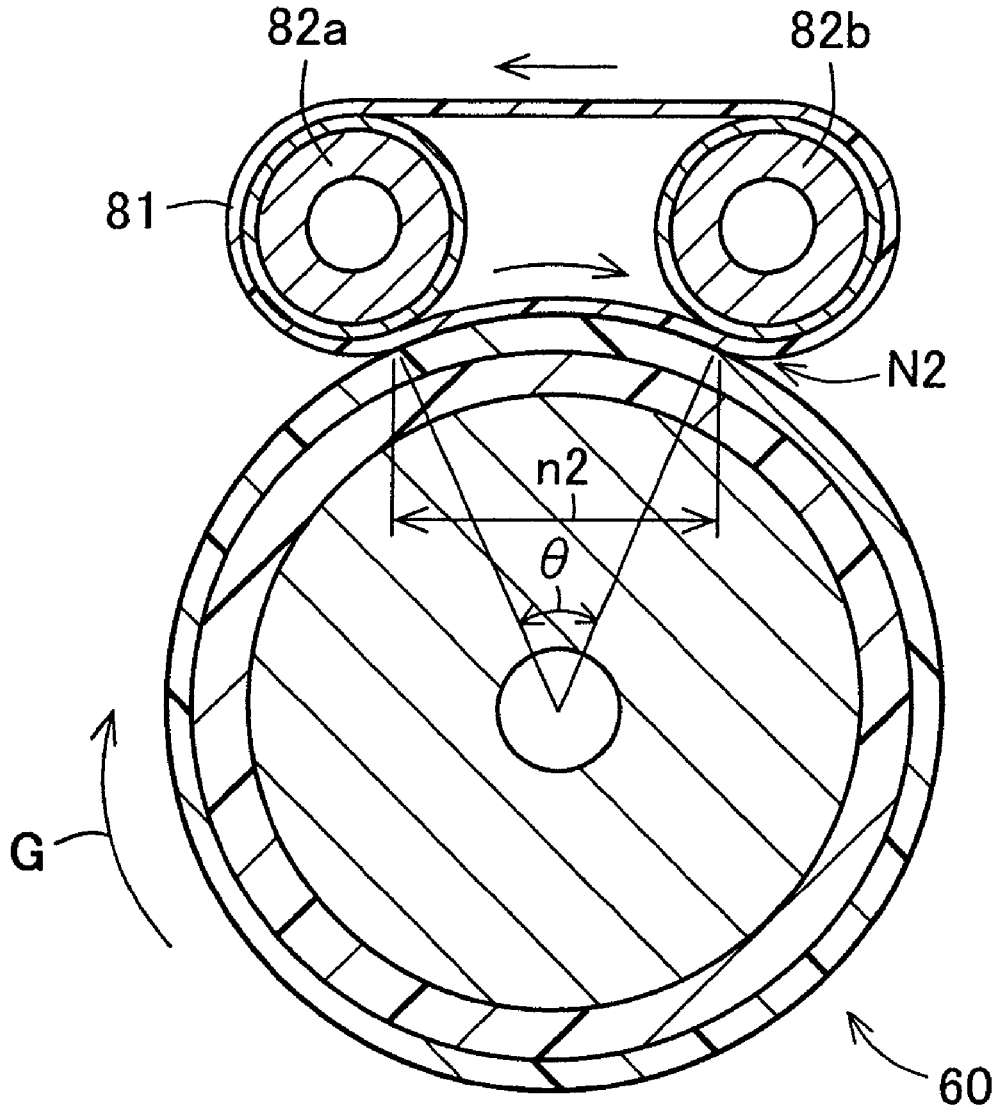
FIG. 2 is an enlarged sectional view showing a part of the structure of the fixing apparatus according to one embodiment of the invention.

FIG. 1 is a cross sectional view simply showing a configuration of the fixing apparatus 40 according to one embodiment of the invention, and FIG. 2 is an enlarged sectional view showing a part of configuration of the fixing apparatus 40 according to one embodiment of the invention. In the fixing apparatus 40 according to one embodiment of the invention, a recording sheet P having an unfixed toner image T formed on its surface is subjected to application of heat and pressure, so that the toner image T is thermally-fused and is eventually fixed onto the recording sheet P. The unfixed toner image T is composed of a toner contained in a developer such as a nonmagnetic one-component developer containing nonmagnetic toner, a nonmagnetic two-component developer containing nonmagnetic toner and carrier, or a magnetic developer containing magnetic toner (hereafter referred to simply as "toner").

As shown in FIG. 1, the fixing apparatus 40 has a fixing roller 60 and a pressure roller 70 which are a pair of fixing sections, an external heater 80, and a web cleaner 90.

The fixing roller 60 and the pressure roller 70 which are the pair of the fixing sections cause a recording sheet P carrying an unfixed toner image T thereon to pass into a fixing nip portion N1 that is a pressure contact portion formed by pressing the fixing roller 60 and the pressure roller 70 against each other., and fix the toner image onto the recording sheet P by heat and pressure.

The fixing roller 60 is a roller-shaped member which is rotatably supported by a supporting portion (not shown) and which rotates at a predetermined velocity in a direction of an arrow G by a driving section (not shown). The fixing roller 60 is used to heat and thus fuse the toner constituting the toner image T borne on the recording sheet P so that the toner is fixed on the recording sheet P.

In the embodiment, a three-layer structure including a metal core 61, an elastic layer 62, and a release layer 63 is used as the fixing roller 60. The metal core 61 assumes the form of a hollow cylinder, is made of aluminum, and has a thickness of 3 mm. The elastic layer 62 is made of silicone rubber, covers the outer peripheral surface of the metal core 61, and has a thickness of 2 mm. The release layer 63 is made of a PFA (copolymer of tetrafluoroethylene and perfluoroalkyl vinyl ether) tube that has a thickness of about 30 μm and covers the surface of the elastic layer 62. The surface hardness of the fixing roller 60 fabricated in this way has an Asker C hardness of 68.

For constituting the metal core 61, it is not limited to aluminum described above and any metal having high thermal conductivity are may be used, such as iron, stainless steel and copper, or alloy thereof and the like Shape example of the metal core 61 is not limited to the above-described cylindrical shape, but may be a columnar shape, and the like shape etc., and preferable is the cylindrical shape which discharges a small amount of heat from the metal core 61.

For constituting the elastic layer 62, any material having rubber elasticity may be used without particular limitation, and preferably used is a material which is also excellent in heat resistance. Specific examples of such a material include silicone rubber described above, fluoro-rubber, and fluoro-silicone rubber. Among these materials, preferable is the silicone rubber which is particularly excellent in rubber elasticity.

No restrictions are imposed on the material of the release layer 63 as long as the material is excellent in heatproofness and durability and shows good toner-release characteristics. For example, the material can be fluororesins (such as PTFE (polytetrafluoroethylene)) and fluororubber, as well as the above-described PFA.

Further, the surface hardness of the fixing roller 60 preferably has an Asker C hardness of 30 to 80.

A heater lamp 64 acting as a heat source for the fixing roller 60 is mounted inside the metal core 61. The heater lamp 64 is electrically energized from a control circuit (not shown) and radiates infrared light. The infrared light is absorbed by the inner surface of the fixing roller 60, so that the inner surface is heated. As a result, the whole fixing roller 60 is heated. In the embodiment, a halogen lamp having a rated power of 500 W is used as the heater lamp 64 that is for use in an image forming apparatus (such as a copier, printer, or combined machine) for performing processing for producing an image by feeding the A4 size sheets of paper vertically. The heater lamp 64 corresponds to a first heat-generating portion.

In the fixing apparatus 40 of the invention, the heater lamp 64 is not used to supplement the amount of heat taken away by the recording sheet P (i.e., to maintain the surface temperature of the fixing roller 60) but chiefly used to maintain high the temperature inside the fixing roller 60 for preventing flow of heat from the surface of the fixing roller 60 toward the inside. Consequently, heat can be supplied efficiently from the external heater 80 to the surface of the roller 60 such that the amount of heat supplied from the external heater 80 to the surface of the fixing roller 60 is not removed into the roller 60.

Furthermore, the heater lamp 64 is used to supplement an amount of heat corresponding to the amount of heat deprived of by the pressure roller 70, the amount of heat deprived of by the web cleaner 90, and the amount of heat dissipated into the free space. Because the amount of heat supplemented by the heater lamp 64 is smaller than the amount of heat which is taken away by the recording sheet P and which is supplemented by the external heater 80, the preset temperature of the heater lamp 64 can be set lower than where the amount of heat taken away by the recording sheet P is supplemented. Consequently, an overshoot that would normally occur at the end of feeding of the paper or when a paper jam takes place can be prevented; otherwise, the surface temperature of the fixing roller 60 would exceed 300° C. and the elastic layer 62 of the fixing roller 60 would be thermally deteriorated. Hence, the durability of the fixing roller 60 can be improved.

The aforementioned overshoot is a phenomenon in which when the operation of each member is stopped at the end of feeding of the paper or when a paper jam takes place, heat produced by support rollers 82*a* and 82*b* (described later) is transmitted to an endless belt 81 (described later) and thus the temperature of the surface of the fixing roller 60 is elevated, whereby the temperature of the portions of the halted support rollers 82*a* and 82*b* in contact with the endless belt 81 and fixing roller 60 is raised to above 240° C. temporarily. Since there are also the influences of radiative heat from the glass tube of the heater lamp 64 that has been deactivated, the temperature raised by the overshoot does not drop immediately. If the surface temperature of the fixing roller 60 exceeds 300° C. due to the overshoot described above, there is the danger that the elastic layer 62 at the surface of the fixing roller 60 is thermally deteriorated and damaged.

The pressure roller 70 is a roller-like member that is rotatably supported by support section (not shown) vertically below the fixing roller 60. The pressure roller 70 rotates in the direction of the arrow H depending on the rotation of the fixing roller 60 and. When the unfixed toner image T is heated to be fixed onto the recording sheet P by the fixing roller 60, the pressure roller 70 presses the fused toner onto the recording sheet P to thereby promote the fixing of the toner image T onto the recording sheet P.

In the embodiment, a three-layer structure including a metal core 71, an elastic layer 72, and a release layer 73 is used as the pressure roller 70. The metal core 71 assumes the form of a hollow cylinder, is made of aluminum, and has a thickness of 3 mm. The elastic layer 72 is made of silicone rubber, covers the outer peripheral surface of the metal core 71, and has a thickness of 2 mm. The release layer 73 is made of a PFA (copolymer of tetrafluoroethylene and perfluoroalkyl vinyl ether) tube that has a thickness of about 30 μm and covers the surface of the elastic layer 72. The surface hardness of the pressure roller 70 fabricated in this way has an Asker C hardness of 75.

The materials of the metal core 71, elastic layer 72, and release layer 73 which may be metallic or non-metallic can be identical with the metal or non-metal materials of the metal core 61, elastic layer 62, and release layer 63, respectively, of the fixing roller 60. The metal core 71 is similar in shape to the metal core 61 of the fixing roller 60.

Preferably, the surface hardness of the pressure roller 70 has an Asker C hardness of 40 to 90.

A heater lamp 74 acting as a heat source for the pressure roller 70 is mounted inside the metal core 71. A heater lamp 74 (not shown) emanates light to cause infrared ray emission by supplying power from a control circuit (not shown). Consequently, the inner surface of the pressure roller 70 absorbs infrared light and becomes heated. The whole pressure roller 70 is heated. In the embodiment, a halogen lamp having a rated power of 450 W is used as the heater lamp 74.

In the embodiment, each of the fixing roller 60 and pressure roller 70 has an outside diameter of 40 mm. The rollers are pressed against with each other at a given load of 600 N by an elastic member (not shown) such as a spring. As a result, a fixing nip portion N1 where the fixing roller 60 and pressure roller 70 are in abutment with each other is formed between the outer peripheral surface of the fixing roller 60 and the outer peripheral surface of the pressure roller 70. The fixing nip width that is the width of the fixing nip portion N1 as viewed in the direction of conveyance of the recording sheet P is 7.5 mm in the embodiment.

The surface of the fixing roller 60 is heated to a second preset temperature, 180° C. in this example. Under this condition, the recording sheet P on which an unfixed toner image T is formed is supplied into the fixing nip portion N1 and passed across it. As a consequence, the toner image T is fixed on the recording sheet P. During the interval when the recording sheet P is passing through the fixing nip region N1, the fixing roller 60 is kept in contact with the toner image-bearing surface of the recording sheet P, whereas the pressure roller 70 is kept in contact with the other surface of the recording sheet P opposite from the toner image-bearing surface.

The fixing roller 60 is rotatably driven by a driving motor (not shown) in the direction of the arrow G. Moreover, the pressure roller 70 is rotated depending on the rotation of the fixing roller 60 in the direction of the arrow H. Therefore, as shown in FIG. 1, the fixing roller 60 and the pressure roller 70 are rotated in different directions. In this state, the recording sheet P passes through the fixing nip region N1.

The fixing roller 60 is rotated at a given rotational speed under control of a drive motor. The recording sheet P on which the unfixed toner image T has been formed is conveyed into the fixing nip portion N1 at given fixing speed and copy speed corresponding to the rotational speed. Fixing is done by heat and pressure. The fixing speed, which means a so-called process speed, is set at 220 mm/sec, in the embodiment. The copying speed means the number of copies per minute. For example, the copying speed is set at 40 copies/min in the embodiment.

The external heater 80 has the endless belt 81 for bringing a heating nip portion N2 into contact with the fixing roller 60 to heat the surface of the fixing roller 60, and the plurality (two in the embodiment) of support rollers 82*a* and 82*b* supporting the endless belt 81 therearound so as to give tension, and each having heater lamps 83*a* and 83*b* incorporated therein.

The endless belt 81 is turnably supported around the support rollers 82*a* and 82*b* with tension. The support rollers 82*a* and 82*b* are mounted to be rotatable about two axes, respectively, substantially parallel to the axes of the fixing roller 60 and pressure roller 70. The support rollers 82*a* and 82*b* are supported to side frames (not shown) in a parallel relation such that the distance between the axes of the rollers is held constant. This prevents deviation of the distance between the axes of the rollers; otherwise, the endless belt 81 would make serpentine motion. The support rollers 82*a* and 82*b* are disposed on the opposite side of the axis of the fixing roller 60 from the fixing nip portion N1 and near the outer peripheral surface of the fixing roller 60. A space is left between the rollers 82*a* and 82*b* to permit at least the endless belt 81 to be displaced. In the embodiment, the support rollers are so disposed that the distance between the axes of the rollers is 22 mm.

In the embodiment, a two-layer structure having an inside diameter of 30 mm is used as the endless belt 81. The two-layer structure has a substrate in the form of a hollow cylinder and a release layer having a thickness of 10 μm. The substrate is made of polyimide in which carbon black is dispersed. The release layer is formed on the outer peripheral surface of the substrate and made of fluororesin in which PTFE and PFA are mixed.

No restrictions are imposed on the material of the substrate as long as it has excellent heatproofness and durability. Examples of the material include heat-resistant resins (such as the above-described polyimide) and metal materials (such as stainless steel, nickel, and iron). Preferably, the material is polyimide in that it is excellent in durability and heatproofness.

As described previously, the thickness of the endless belt 81 is set to 0.08 or more and 0.14 mm or less. Consequently, cracking at the ends of the endless belt 81 can be prevented. Furthermore, poor rotation of the endless belt 81 can be prevented.

If the thickness of the endless belt 81 is less than 0.08 mm, the strength of the endless belt 81 is insufficient and so cracking at the ends of the endless belt 81 takes place easily. If the thickness is in excess of 0.14 mm, the flexibility of the endless belt 81 is lost and, therefore, poor rotation of the endless belt 81 takes place. Poor rotation tends to occur when the endless belt temperature is low. If poor rotation takes place, heat is not easily transmitted from the endless belt to the fixing roller. This reduces the rate at which the temperature of the fixing roller is elevated or it is difficult to maintain the temperature of the fixing roller.

No restrictions are placed on the material of the release layer as long as the material is excellent in heatproofness and toner-release characteristics. One example of the material is a synthetic resin made of a fluororesin such as the aforementioned PFA or PTFE.

Moreover, in order to reduce an offset force against the endless belt 81, namely a force exerted on the endless belt 81 to cause it to move in a direction perpendicular to a direction in which the endless belt 81 turns, the substrate of the endless belt 81 may have its inner peripheral surface coated with fluorine resin or the like.

Further, in the embodiment, aluminum roller-like members made of metal cores 820*a* and 820*b* each in the form of a hollow cylinder having an outside diameter of 16 mm and a thickness of 2 mm are used as the support rollers 82*a* and 82*b*, respectively. The metal cores 820*a* and 820*b* correspond to support roller bodies.

The material of the metal cores 820*a* and 820*b* of the support rollers 82*a* and 82*b* is not limited to the aforementioned aluminum. For example, it may be an iron-based material.

Figure 3A:
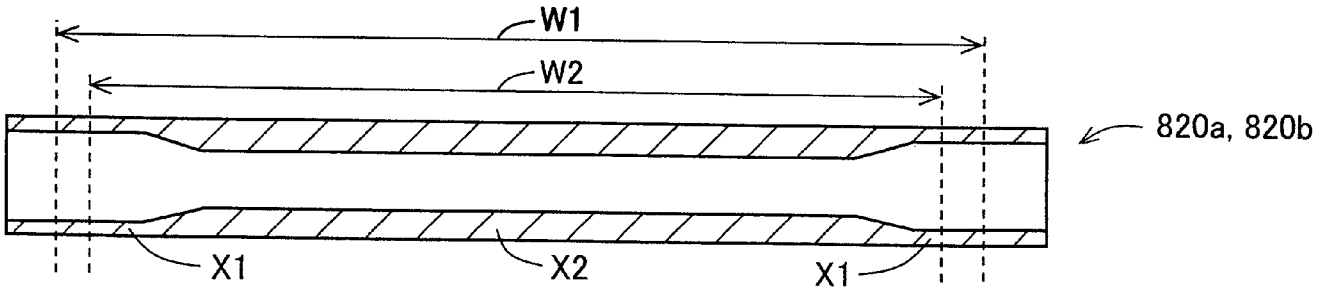
FIGS. 3A to 3C are cross-sectional views showing examples of the shape of metal cores of support rollers
Figure 3B:
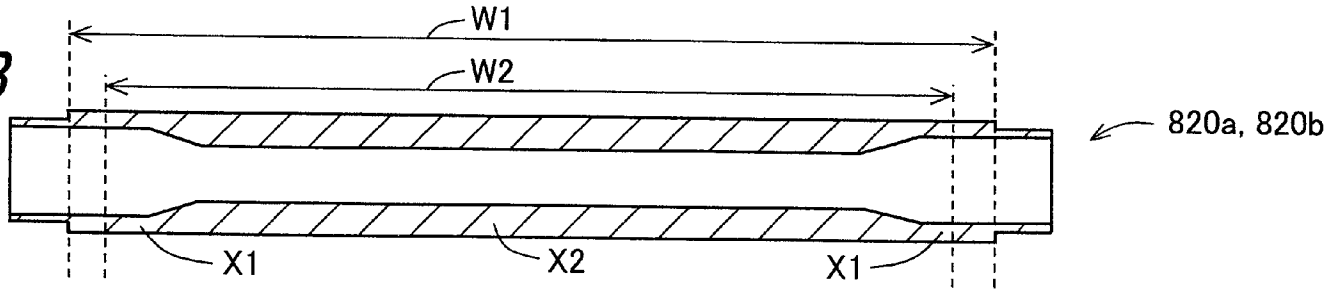
Figure 3C:
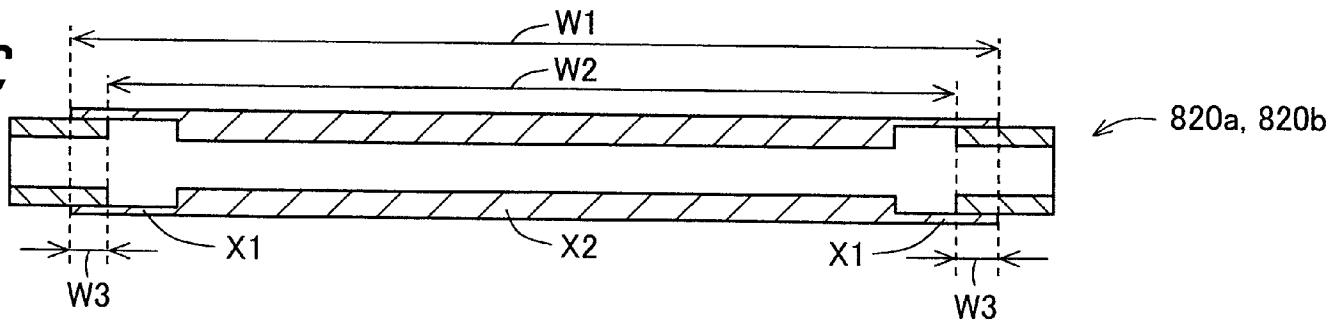

A preferable shape of the metal cores 820*a* and 820*b* is described below. FIGS. 3A to 3C are cross-sectional views showing examples of the shape of the metal cores 820*a* and 820*b* of the support rollers 82*a* and 82*b*. In each of the figures, reference symbol W1 indicates a heating portion. Reference symbol W2 indicates a paper passage portion. Reference symbol W3 indicates a paper non-passage portion.

For example, in a case where the paper is not fed, for example, during warming-up, if the surface temperature of the fixing roller 60 is elevated or maintained, there is the problem that insufficient heating by the heater lamp 64 and flow of heat to the bearing portions mounted at the opposite ends decrease the surface temperature at the longitudinal ends of the fixing roller 60. Such decrease in the surface temperature is especially conspicuous immediately after warming-up. If an image is formed when the surface temperature at the ends of the fixing roller 60 has dropped, there is the possibility that poor image fixing occurs at the ends of the paper.

In order to solve the aforementioned problem arising from decrease of the surface temperatures of the longitudinal ends of the fixing roller 60, it is preferable to shape the metal cores 820*a* and 820*b* of the support rollers 82*a* and 82*b* in such a way that longitudinal both ends X1 are thinner than a longitudinal intermediate portion X2 as shown in FIGS. 3A to 3C. The temperatures of the both ends of the support rollers 82*a* and 82*b* can be prevented from dropping due to insufficient heating by the heater lamps 83*a* and 83*b* (described later) and due to flow of heat to the bearing portions mounted at the ends, by reducing the thicknesses of the longitudinal both ends X1 of the metal cores 820*a* and 820*b* corresponding to the longitudinal both. ends of the fixing roller 60 in this way. Consequently, temperature can be made uniform axially. As a result, the surface of the fixing roller 60 can be heated uniformly. Hence, during the warming-up, the surface temperatures at the longitudinal both ends of the fixing roller 60 can be prevented from decreasing; otherwise, poor fixing would occur at both ends of the paper.

The metal cores 820*a* and 820*b* are so shaped that the longitudinal both ends X1 is thinner than the longitudinal intermediate portion X2 as shown in FIG. 3C. Preferably, the thickness of the portion corresponding to the paper non-passage portion W3 is substantially equal to or greater than the thickness of the longitudinal intermediate portion X2. Consequently, it is possible to prevent the portion corresponding to the paper non-passage portion W3, which would normally tend to become hot because heat is not taken away by the paper, from overheating during feeding of paper. As a consequence, the surface temperature of the fixing roller 60 can be maintained uniform.

Furthermore, according to the need, e.g., where the frictional force produced between the inner surface of the endless belt 81 and each of the outer peripheral surfaces of the support rollers 82*a* and 82*b* is reduced to thereby reduce the laterally shifting force due to serpentine motion, a release layer may be formed on the outer peripheral surface of each of the metal cores 820*a* and 820*b* forming the support rollers 82*a* and 82*b*, respectively. No restrictions are imposed on the material of the release layer as long as the material is excellent in heatproofness, durability, and toner-release characteristics. For example, fluororesins such as PFA and PTFE can be used.

The heater lamps 83*a* and 83*b* for heating the endless belt 81 are mounted inside the metal cores 820*a* and 820*b* of the support rollers 82*a* and 82*b*, respectively. The heater lamps

83*a* and 83*b* emit infrared radiation by being electrically energized from a control circuit (not shown). Consequently, the inner surfaces of the rollers 82*a* and 82*b* absorb the infrared radiation and become heated. The endless belt 81 is heated by the support rollers 82*a* and 82*b* each of which has been heated totally. The endless belt 81 heats the surface of the fixing roller 60. The heater lamps 83*a* and 83*b* correspond to the second heat-generating portions.

To transmit heat from one member to another member in this way, the temperature of the member from which heat is transmitted must be higher. Because of the thermal resistance of the material of each of the members, a temperature difference is created between an outer portion and an inner portion of each of the members. Furthermore, each of the members is deprived of heat by the surroundings by radiative heat and by heat transfer to the air. Because of such heat transfer between members, a given temperature gradient is created across each of the members at some temperature. The member is in a thermally balanced state. In the embodiment, the surface temperature of the fixing roller 60 can be maintained at 180° C. at which good image fixability is obtained by setting the process rate at 220 mm/sec, setting the copy speed at 40 sheets/minute in the case of vertical feeding of sheets of A4 size, and setting the temperatures of the support rollers 82*a* and 82*b* in such a way that the endless belt 81 is heated to 220° C. via the rollers 82*a* and 82*b*.

Preferable amounts of electric power consumed by the heater lamps 83*a* and 83*b* mounted in the support rollers 82*a* and 82*b* are hereinafter described.

For example, during the warming-up, if the operation of each of the members is stopped due to a trouble such as paper jamming at the instant when the surface temperature of the endless belt 81 has reached the first preset temperature, the surface temperature of the endless belt 81 will increase above the preset temperature even if the power supplies for the heater lamps 83*a* and 83*b* included in the rollers 82*a* and 82*b* are immediately turned off, thus producing an overshoot for the following reason. If the power supplies are turned off, the glass tubes of the heater lamps 83*a* and 83*b* remain hot. In addition, an action takes place in such a way as to homogenize the temperature gradient across each of the support rollers 82*a* and 82*b*. If such an overshoot is produced, the rollers 82*a* and 82*b* become hot. The temperatures of the portions of the halted rollers 82*a* and 82*b* which are in contact with the endless belt 81 and fixing roller 60 are raised temporarily. When the surface temperature of the fixing roller 60 at the overheated portions exceeds 300° C., the elastic layer 62 at the surface of the fixing roller 60 is thermally deteriorated and damaged. There is the danger that streaky gloss nonuniformity is produced in the final output image.

In order to solve the foregoing problem arising from the overshoot, it is preferable that the amount of heat produced by each of the heater lamps 83*a* and 83*b* mounted in the support rollers 82*a* and 82*b* is 3,000 W/m or less and that the total amount of heat generated by the lamps is 1,700 W/m or more. This can be achieved by setting the electric power consumed by each of the heater lamps 83*a* and 83*b*. for an A4-sized copier to 400 W or more and 700 W or less, the copier having a lamp emission width of about 230 mm.

The glass tubes of the heater lamps 83*a* and 83*b* can be prevented from overheating by setting the amount of heat generated by each of the lamps 83*a* and 83*b* to 3,000 W/m or less. Because the temperature gradient across each of the support rollers 82*a* and 82*b* can be made milder, generation of an overshoot can be suppressed. Hence, inconveniences due to generation of an overshoot can be suppressed.

The warming-up time is shortened. Where the warming-up time is set to 120 sec, a warming-up time of 120 sec or shorter can be achieved by setting the total amount of heat generated by the heater lamps 83*a* and 63*b* to 1,700 W/m or more.

Two heater lamps were used. Warming-up times and generation of an overshoot were evaluated for A3-sized machines each having a lamp emission width of 320 mm and for A4-sized machines each having a lamp emission width of 230 mm under the conditions where the electric power consumed by each of the heater lamps and the amount of heat generated by each of the heater lamps were varied. The results are shown in Table 1. Electric power consumed indicated in the table is an electric power consumed by respective heater lamps.

TABLE 1

| Amount of generated heat (W/m) | Power consumption (W) of A4-sized machine | Power consumption (W) of A3-sized machine | Warming-up time | Overshoot |
|---|---|---|---|---|
| 1,500 | 345 | 480 | Poor | Good |
| 1,600 | 370 | 510 | Poor | Good |
| 1,700 | 390 | 545 | Not bad | Good |
| 1,800 | 415 | 575 | Good | Good |
| 1,900 | 435 | 610 | Good | Good |
| 2,000 | 460 | 640 | Good | Good |
| 2,100 | 485 | 670 | Good | Good |
| 2,200 | 505 | 705 | Good | Good |
| 2,300 | 530 | 735 | Good | Good |
| 2,400 | 550 | 770 | Good | Good |
| 2,500 | 575 | 800 | Good | Good |
| 2,600 | 600 | 830 | Good | Good |
| 2,700 | 620 | 860 | Good | Good |
| 2,800 | 645 | 890 | Good | Good |
| 2,900 | 670 | 930 | Good | Good |
| 3,000 | 690 | 960 | Good | Not bad |
| 3,100 | 715 | 990 | Good | Poor |
| 3,200 | 735 | 1,025 | Good | Poor |

Each of the heater lamps 83*a* and 83*b* which achieve the target warming-up time of 120 seconds and can prevent overshoot produces an amount of heat of 3,000 W/m or less. For the A3-sized machine, the rated power is 960 W or less. For the A4-sized machine, the rated power is 700 W or less.

The endless belt 81 is mounted upstream of the fixing nip portion N1 in the direction of rotation of the fixing roller 60. The endless belt is pressed against the outer peripheral surface of the roller 60 at a given load (40 N in this example). Consequently, the heating nip portion N2 where the endless belt 81 and the fixing roller 60 make contact with each other is formed between the outer peripheral surface of the endless belt 81 and the outer peripheral surface of the fixing roller 60.

Further, as the fixing roller 60 is rotated, the endless belt 81 turns depending on the rotation of the fixing roller 60. In accompaniment therewith, the support rollers 82*a* and 82*b* are rotated depending on the turning of the endless belt 81. The surface of the endless belt 81 is heated to a predetermined temperature, for example, 220° C. by the support rollers 82*a* and 82*b*. The surface of the fixing roller 60 is heated via the endless belt 81.

Preferable conditions for the heating nip width that is the width of the heating nip portion N2 as viewed in the direction of rotation of the fixing roller 60 are hereinafter described.

During warming-up time, when the endless belt 81 and fixing roller 60 are elevated in temperature, the temperature of the fixing roller 60 rises at a higher rate before the endless belt 81 reaches the first preset temperature (e.g., 220° C.). After the endless belt 81 has reached the preset temperature, the temperature of the fixing roller 60 rises at a lower rate.

Accordingly, in order to shorten the time taken for the fixing roller 60 to reach the second preset time (e.g., 180° C.), it is necessary that the fixing roller 60 reach the second preset temperature before the endless belt 81 reaches the first preset temperature. This can be achieved, for example, by controlling the amount of heat transferred from the endless belt 81 to the fixing roller 60.

The amount of heat flow from the endless belt 81 to the fixing roller 60 depends on the heating nip width, which can be represented by the angle θ (FIG. 2) through which the endless belt 81 is arranged. The angle θ is herein referred to as the contact area angle and can be represented by an angular range around the center axis of the fixing roller 60.

The amount of heat that the endless belt 81 can have depends on the heat capacity of the endless belt 81 and on the temperature. The amount of heat that the endless belt 81 can supply to the fixing roller 60 depends on the time for which the endless belt 81 is in contact with the fixing roller 60. That is, where the time for which the endless belt 81 is in contact with the fixing roller 60 is short, the amount of heat is not easily moved from the endless belt 81 to the fixing roller 60. On the other hand, where the time for which the endless belt 81 is in contact with the fixing roller 60 is long, the movement of the amount of heat from the endless belt 81 to the fixing roller 60 will converge within the time for which the endless belt and roller are in contact with each other. The endless belt will be in contact with the roller in vain for a long time.

In the invention, the contact area angle θ is set to 50° or more and 90° or less. That is, the width n2 of the heating nip portion N2 is formed in an angular range of 50° or more and 90° or less around the center axis of the fixing roller 60. Consequently, the amount of heat flow from the endless belt 81 to the fixing roller 60 can be controlled well. Thus, the fixing roller 60 can be made to reach the second preset temperature before the endless belt 81 reaches the first preset temperature. As a result, the time taken for the fixing roller 60 to reach the second preset temperature, e.g., warming-up time, can be shortened.

If the contact area angle θ is less than 50°, the amount of heat is not easily moved from the endless belt 81 to the fixing roller 60 and so the time taken for the fixing roller 60 to reach the second preset temperature, e.g., warming-up time, is prolonged. If the contact area angle θ is in excess of 90°, the time for which the endless belt 81 is in contact with the fixing roller 60 is prolonged wastelessly. Hence, heat cannot be moved efficiently. Furthermore, the heat capacity of the endless belt 81 increases to secure the contact area angle θ and so the time taken for the fixing roller 60 to reach the second preset temperature is prolonged.

In the vicinity of the outer peripheral surface of the fixing roller 60 and the pressure roller 70 are disposed respectively the thermistors 65 and 75 acting as temperature sensors for detecting surface temperature of the fixing roller 60 and pressure roller 70. Further, in the vicinity of the outer peripheral surface of the endless belt 81 where is supported around the support rollers 82*a* and 82*b* with tension, the thermistors 84*a* and 84*b* are disposed acting as temperature sensors for detecting surface temperature of the endless belt 81, so as to be contact with the outer peripheral surface of the endless belt 81.

Those thermistors 65, 75, 84*a* and 84*b* serve as temperature detecting sections. Detected temperature data is provided to the control circuit (not shown) having the function of a temperature control section. On the basis of the temperature data, the control circuit controls power supply for the heater lamp 64, the heater lamp 74, the heater lamp 83*a* and 83*b* so as for the surface temperatures of the fixing roller 60, the pressure roller 70 and the endless belt 81 to reach predetermined levels, Temperature control provided when a warming-up operation is performed under control of the control circuit is described by referring to FIG. 4, which is a graph showing the relationship between a time having elapsed from the start of the warming-up and surface temperatures of the endless belt 81 and fixing roller 60. Line A indicates the surface temperature of the endless belt 81. Line B indicates the surface temperature of the fixing roller 60. Reference symbol t1 indicates the warming-up time. Reference symbol t2 indicates a period from the start of feeding of paper to the time at which the internal temperature of the fixing roller 60 has risen completely.

Figure 4:
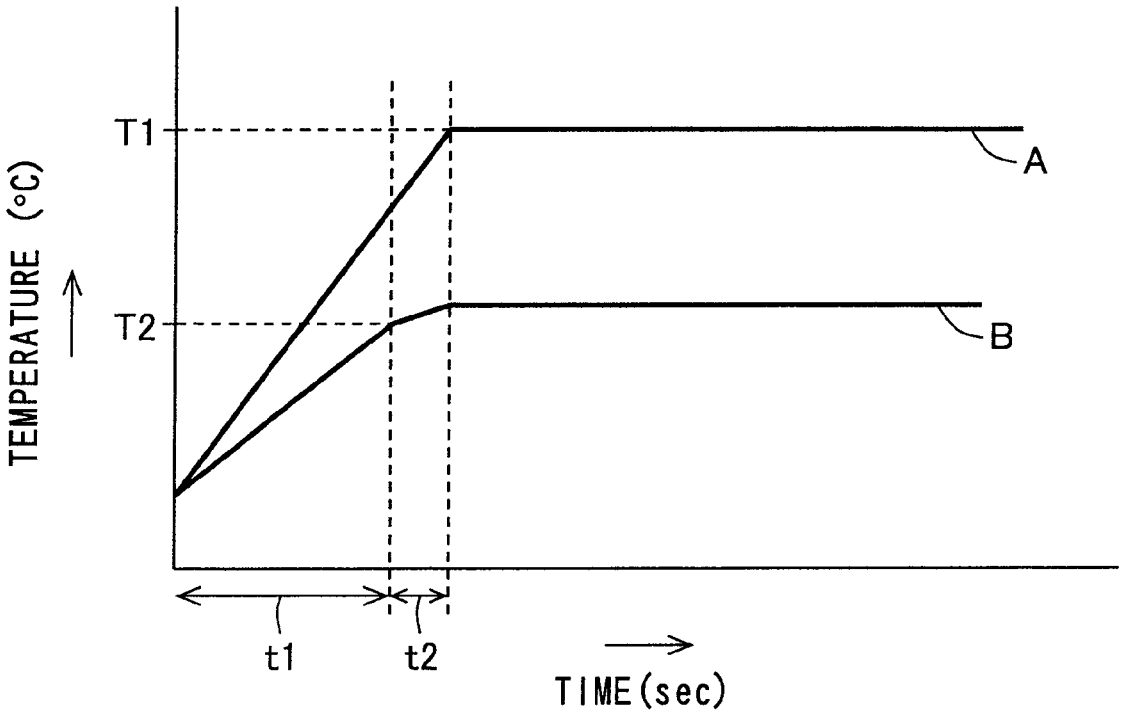
FIG. 4 is a graph showing the relationship between a time having elapsed from the start of the warming-up and surface temperatures of an endless belt and a fixing roller.

The control circuit controls the electrical energization of the heater lamps 64, 83*a*, and 83*b* during the warming-up such that the surface temperature B of the fixing roller 60 reaches the second preset temperature T2 (e.g., 180° C.) before the surface temperature A of the endless belt 81 reaches the first preset temperature Ti (e.g., 220° C.) as shown in FIG. 4. Thus, the temperatures of the lamps 64, 83*a*, and 83*b* are controlled.

In this way, it is desirable that the heater lamps 64, 83*a*, and 83*b* are so controlled that, before the surface temperature of the endless belt 81 reaches the first preset temperature T1, the surface temperature of the fixing roller 60 reaches the second preset temperature T2 when the fixing roller 60, pressure roller 70, and support rollers 82*a*, 82*b* are rotating, for example, during the warming-up. Consequently, the time taken for the surface temperature of the fixing roller 60 to reach the second preset time T2, e.g., warming-up time, can be shortened further.

The first and second preset temperatures T1 and T2 of the endless belt 81 and fixing roller 60, respectively, are not limited to the above-described temperatures. It is only required that the surface temperature B of the fixing roller 60 reach the second preset temperature T2 before the surface temperature A of the endless belt 81 reaches the first preset temperature T1. Preferably, the first preset temperature TI is set to below 230° C. because of the problem of overshoot. The second preset temperature T2 needs to be a temperature at which fixing can be done. In the fixing roller 60, the surface temperature B needs to be kept constant to maintain the fixability after the surface temperature B has reached the second preset temperature T2. This can be accomplished by adjusting the process speed or the width of the fixing nip portion N1.

Figure 5:
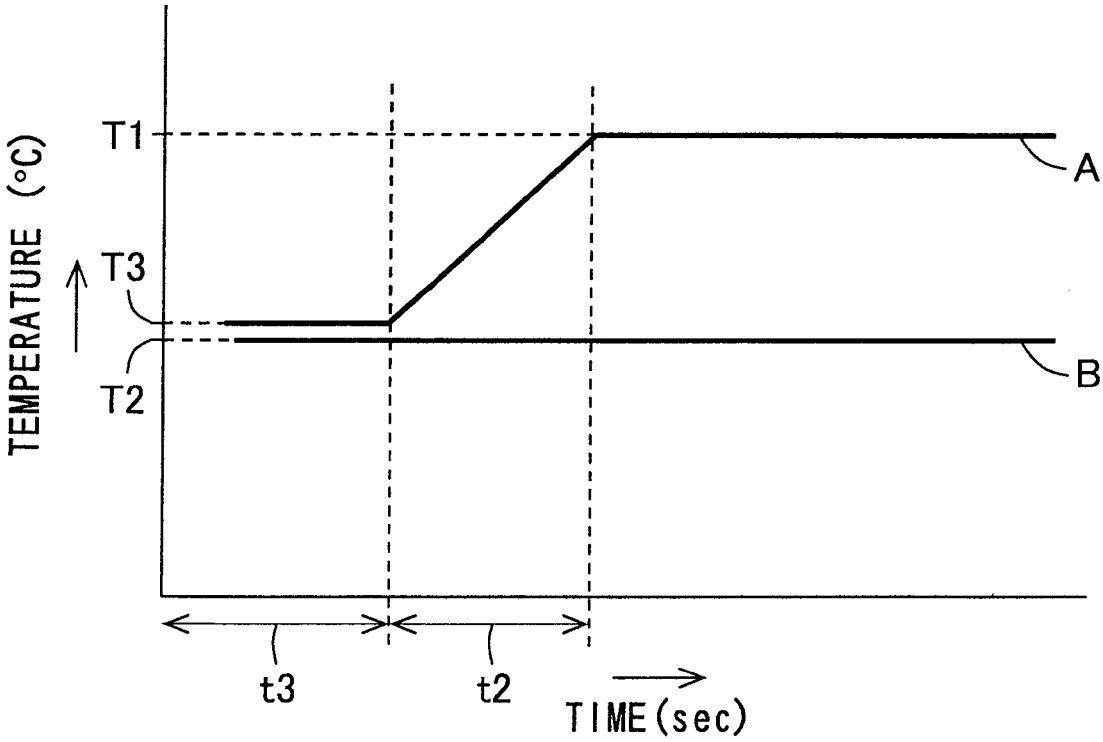
FIG. 5 is a graph showing the relationship between a time having elapsed from a time of a ready-operation and surface temperatures of the endless belt and the fixing roller.

Temperature control provided by the control circuit in a time of a ready-operation is hereinafter described by referring to FIG. 5. Herein, the ready-operation means a state where the operation is ceased while maintaining the set temperatures of the roller members. In the graph of FIG. 5, the period of the ready-operation is indicated by t3. In the fixing apparatus 40 of the external belt heating type, the surface temperature of the fixing roller 60 responds quickly to variation of heat supplied from the endless belt 81. That is, when the surface temperature of the endless belt 81 rises, the surface temperature of the fixing roller 60 rises. When the temperature of the endless belt 81 falls, the surface temperature of the fixing roller 60 decreases. Therefore, when the power supplies for the heater lamps 83*a* and 83*b* mounted in the support rollers 82*a* and 82*b* are turned off, the surface temperature of the fixing roller 60 drops.

As indicated by t2 in FIG. 4, the surface temperature of the fixing roller 60 rises at a reduced rate because heat is taken away by the paper passed through the fixing nip portion N1. At this time, if the power supplies for the heater lamps 83*a* and 83*b* are turned off, there is the danger that the surface temperature of the fixing roller 60 drops, producing poor fixing.

To solve the aforementioned problem, it is preferable to determine a preset temperature T3 of the surface of the endless belt 81 in the ready-operation (especially, the temperature of the portions of the endless belt arranged around the support rollers 82*a* and 82*b*) such that the surface temperature T3 becomes lower than the preset temperature T1 during feeding of paper. Consequently, after the start of the feeding of paper, the temperature of the endless belt 81 rises from the preset temperature T3 in the ready-operation toward the preset temperature T1 used during feeding of paper at least until the internal temperature of the fixing roller 60 rises completely. Therefore, it is assured that the heater lamps 83*a* and 83*b* are lit up. Accordingly, generation of poor fixing can be prevented.

Further, in the ready-operation, when the support rollers 82*a* and 82*b* are in contact with the fixing roller 60 via the endless belt 81, the surface temperature of the portions of the fixing roller 60 in contact with the support rollers 82*a* and 82*b* becomes higher than any other portion. For this reason, gloss nonuniformity may be produced in the final image.

In order to solve the above-described problem, it is preferable that control is so made that the surface temperature of the endless belt 81 in the ready-operation (especially, the temperature of the portions of the endless belt arranged around the support rollers 82*a* and 82*b*) is equal to or higher than a same temperature as the surface temperature of the fixing roller 60 and is not more than a temperature which is higher than the surface temperature of fixing roller by 10° C.

In this way, it is preferable that the heater lamps 64 and 83*a*, 83*b* is so controlled that the surface temperature of the endless belt 81 is equal to or higher than a same temperature as the surface temperature of the fixing roller 60 and is not more than a temperature which is higher than the surface of fixing roller 60 by 10° C. when the fixing roller 60, pressure roller 70, and support rollers 82*a*, 82*b* are ceased to rotate as in the ready-operation.

Consequently, when the fixing roller 60, pressure roller 70, and support rollers 82*a*, 82*b* are ceased to rotate, e.g., in the ready-operation, the temperature difference generated across the surface of the fixing roller 60 can be made smaller while supplying heat to the surface of the fixing roller 60 via the endless belt 81. As a consequence, gloss nonuniformity in the final image can be prevented.

When the aforementioned control is provided, it is preferable that the endless belt 81 makes contact with the fixing roller 60. This dispenses with any separating mechanism for placing the endless belt 81 away from the fixing roller 60 when the fixing roller 60, pressure roller 70, and support rollers 82*a*, 82*b* are ceased to rotate. As a result, the structure of the apparatus can be simplified and made more compact.

The web cleaner 90 includes, for example, a cleaning web, a feeding roller, a pressure-contact roller, and a winding roller. The cleaning web comes into pressure-contact with the surface of the fixing roller to thereby remove the offset toner. The feeding roller serves to reel out the web. The pressure-contact roller serves to bring the cleaning web into pressure-contact with the surface of the fixing roller 60. The winding roller is driven to rotate with a driving force given by a driving section (not shown), thereby taking up the web. In the cleaning section, the winding roller is driven to rotate, which drives the feeding roller to reel out the web, and the web cleaner 90 is brought into contact with the surface of the fixing roller 60, thereby removing the offset toner, and thereafter moved off from the fixing roller 60.

In this way, the fixing apparatus 40 of the invention has the fixing section of one pair pressed against with each other, the endless belt 81 for heating the surface of the fixing roller 60 by bringing the heating nip portion N2 into contact with the fixing roller 60, and the support rollers 82*a*, 82*b*. The fixing means are composed of the fixing roller 60 and pressure roller 70, the fixing roller 60 having the heater lamp 64 therein. The endless belt 81 is supported around the support rollers 82*a* and 82*b* which have the heater lamps 83*a* and 83*b* therein, with tension. The thickness of the endless belt 81 is 0.08 mm or more and 0.14 mm or less. The heating nip portion N2 is formed in an angular range of 50° or more and 90° or less around the center axis of the fixing roller 60.

Consequently, the warming-up time can be shortened. Furthermore, the surface temperature of the fixing roller 60 can be maintained stably.

While, in the embodiment, the recording sheet P is used as a recording material, there is no particular limitation. Any other recording material may be used instead so long as it is conveyable in the fixing nip region N1 between the fixing roller 60 and the pressure roller 70.

Furthermore, in the embodiment, the endless belt 81 is supported with tension by using the two support rollers 82*a* and 82*b*. The invention is not limited to this structure. For example, where the width of the heating nip portion N2 should be set to a larger value, a tension roller separate from the above-described two support rollers 82*a* and 82*b* may be mounted, and the endless belt 81 may be supported with tension by using the three or more support rollers.

[Image Forming Apparatus]

Figure 6:
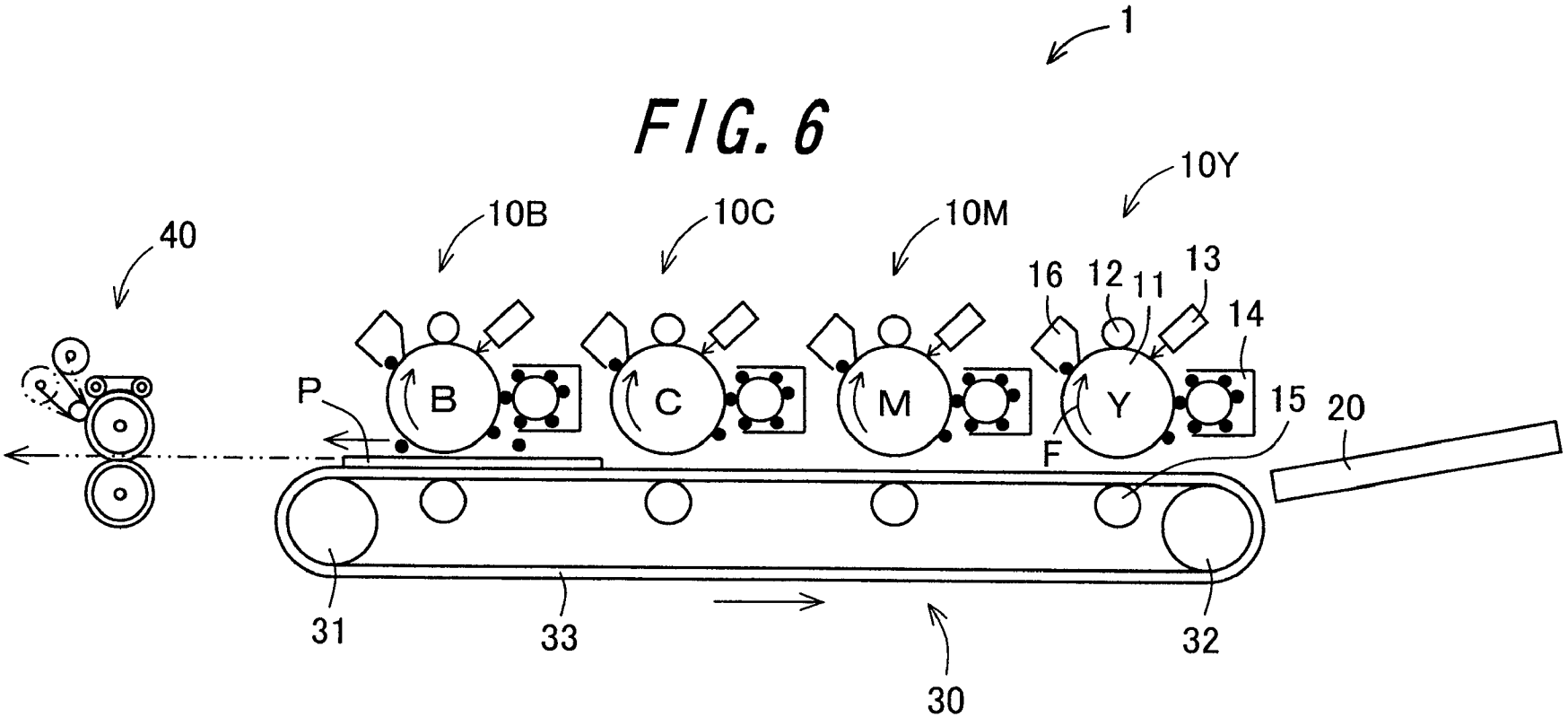
FIG. 6 is a schematic view showing an example of the structure of an image forming apparatus having the fixing apparatus of the invention.

FIG. 6 is a schematic view showing an example of the structure of an image forming apparatus having the fixing apparatus 40 of the invention.

The image forming apparatus 1 is built for example as a dry electrophotographic color image forming apparatus. In the image forming apparatus 1, for example, on the basis of image data transmitted from terminal units connected by the network or read by a scanner, a multicolored image or monochromatic image is formed on a predetermined recording sheet P.

The image forming apparatus 1 comprises four pieces of visible image forming units 10Y, 10M, 10C, and 10B (hereafter also referred to collectively as "visible image forming unit 10"), a feeding tray 20, and a recording sheet conveying section 30 and the fixing apparatus 40.

In order to deal with various colors: yellow (Y); magenta (M); cyan (C), and black (K), the four visible image forming units 10Y, 10M, 10C, and 10B are arranged side by side in the image forming apparatus 1. The visible image forming unit 10Y effects image formation with use of a yellow (Y)-color toner, the visible image forming unit 10M effects image formation with use of a magenta (M)-color toner, the visible image forming unit 10C effects image formation with use of a cyan (C)-color toner, and the visible image forming unit 10B effects image formation with use of a black (K)-color toner. More specifically, the four visible image forming units 10 are arranged along a recording-sheet P conveyance path formed so as to provide connection between the recording-sheet P feeding tray 20 and the fixing apparatus 40. That is, the image forming apparatus 1 is of a so-called tandem type.

The visible image forming units 10 have substantially the same configuration, the sole difference being the color of toner for use. Each of the visible image forming units 10 is constructed by disposing, around a photoreceptor drum 11, a charging roller 12, a laser scanning section 13, a developing device 14, a transfer roller 15, and a cleaner unit 16. Note that the developing devices 14 of the visible image forming units 10Y, 10M, 10C, and 10B hold a yellow (Y)-color toner, a magenta (M)-color toner, a cyan (C)-color toner, and a black (K)-color toner, respectively.

On the photoreceptor drum 11 is borne a toner image formed. The charging roller 12 effects charging on the surface of the photoreceptor drum 11 evenly at a predetermined potential. The laser scanning section 13 exposes the surface of the photoreceptor drum 11 charged by the charging roller 12 to light on the basis of image data inputted to the image forming apparatus 1, whereupon an electrostatic latent image is formed on the surface of the photoreceptor drum 11. The developing device 14 turns the electrostatic latent image formed on the surface of the photoreceptor drum 11 into a visible image by means of the toner of respective colors. The transfer roller 15 receives application of a bias voltage of a polarity reverse to the polarity of the charge on the toner thereby to transfer the formed toner image onto the recording sheet P conveyed by the recording sheet conveying section 30 which will be described later on. The cleaner unit 16 removes and collects residual toner portions which remain on the photoreceptor drum 11 following the development process conducted by the developing device 14 and the process to transfer the toner image formed on the photoreceptor drum 11. In the presence of the four different colors, the above-described toner image transference onto the recording sheet P is conducted separately for individual colors; that is, repeated four times.

The visible image forming unit 10 performs toner image formation on the recording sheet P in the following manner. After the surface of the photoreceptor drum 11 is charged evenly by the charging roller 12, on the basis of the input image data, the surface of the photoreceptor drum 11 is exposed to light by the laser scanning section 13, whereupon an electrostatic latent image is formed thereon. After that, the electrostatic latent image formed on the surface of the photoreceptor drum 11 is developed by the developing device 14 to effect toner-image visualization. Then, by the transfer roller 15 to which is impressed a bias voltage of a polarity reverse to the polarity of the charge on the toner, the visualized toner images of different colors are transferred and overlaid one after another onto the recording sheet P conveyed from the feeding tray 20 to the recording sheet conveying section 30.

It is possible to place a plurality of recording sheets P in the feeding tray 20. The plurality of recording sheets P placed in the feeding tray 20 are separately fed to the visible image forming unit 10Y arranged at the nearest side of the feeding tray 20, one by one.

The recording sheet conveying section 30 comprises a driving roller 31, an idling roller 32, and a conveyance belt 33. The recording sheet P fed from the feeding tray 20 is conveyed by the recording sheet conveying section 30 in such a manner that the toner image formed by the visible image forming unit 10 can be transferred onto the recording sheet P properly. The driving roller 31 and the idling roller 32 allows the conveyance belt 33 designed in an endless-belt form to be suspended in a tensioned state. The driving roller 31 is rotated under the control of a driving section (not shown), so that the conveyance belt 33 can be turned along the conveyance path at a predetermined circumferential velocity, for example, 220 mm/sec. The conveyance belt 33 undergoes static electricity generation at its outer peripheral surface, wherefore the recording sheet P is conveyed while being electrostatically attracted to the conveyance belt 33.

In this way, the recording sheet P is conveyed along the conveyance path by the conveyance belt 33, during which period the toner image is transferred onto the surface of the recording sheet P. After that, the recording sheet P is separated from the conveyance belt 33 due to the curvature of the driving roller 31, and is then conveyed to the fixing apparatus 40. In the fixing apparatus 40, adequate heat and pressure are applied to the recording sheet P, whereupon the toner is melted and fixed the toner image onto the surface of the recording sheet P. As a result, a full-color image can be formed.

In this way, the image forming apparatus 1 of the invention can stably form a high-quality image having excellent fixability by being equipped with the fixing apparatus 40 of the invention.

EXAMPLES

Hereinafter, the invention will be described concretely with Examples and Comparative examples. It should be noted that the invention is not limited to the examples set forth hereunder insofar as there is no departure from the spirit and scope of the invention.

Example 1

A fixing apparatus of Example 1 is identical in construction with the fixing apparatus 40 shown in FIG. 1. Hereinafter, the specifications of components constituting the fixing apparatus of Example 1 will be explained.

A member for use as the fixing roller 60 was constructed by forming, over the outer peripheral surface of a metal core 61 having a thickness of 3 mm in the form of a hollow cylinder and made of aluminum, a 2 mm-thick silicone rubber-made elastic layer 62 and a release layer 63 made of a 30 μm-thick PFA tube, successively in the order named, and the outside diameter of the fixing roller was 40 mm.

A member for use as the pressure roller 70 was constructed by forming, over the outer peripheral surface of a metal core 71 having a thickness of 3 mm in the form of a hollow cylinder and made of aluminum, a 2 mm-thick silicone rubber-made elastic layer 72 and a release layer 73 made of a 30 μm-thick PFA tube, successively in the order named, and the outside diameter of the pressure roller was 40.

The endless belt 81 had a substrate in the form of a hollow cylinder having an inside diameter of 30 mm and the release layer having a thickness of 10 μm. The whole thickness of the endless belt 81 was 0.08 mm. The substrate was made of polyimide in which carbon black was dispersed. The release layer was formed on the outer peripheral surface of the substrate and made of fluororesin in which PTFE and PFA were mixed.

Roller-like members made of the metal cores 820*a* and 820*b*, respectively, each in the form of a hollow cylinder and made of aluminum were used as the support rollers 82*a* and 82*b*. Respective metal cores had an outside diameter of 16 mm and a thickness of 2 mm. The support rollers 82*a* and 82*b* were so disposed that the distance between their axes was 22 mm. At this time, the contact area angle θ was 60 degrees. The width of the heating nip portion N2 was 20 mm.

A halogen lamp having a rated power of 500 W was used as each of the heater lamps 64, 83*a*, and 83*b*. A halogen lamp having a rated power of 450 W was used as the heater lamp 74.

The fixing load in the fixing nip region N1 and the pressing load in the heating nip region N2 were respectively set at 600 N and 40 N. The fixing nip width of the fixing nip region N1 was set at 7.5 mm.

Example 2

A fixing apparatus of Example 2 was used having a similar structure to the fixing apparatus of Example 1 except that the whole thickness of the endless belt 81 was 0.10 mm.

Example 3

A fixing apparatus of Example 3 was used having a similar structure to the fixing apparatus of Example 1 except that the whole thickness of the endless belt 81 was 0.14 mm.

Comparative Example 1

A fixing apparatus of Comparative Example 1 was used having a similar structure to the fixing apparatus of Example 1 except that the whole thickness of the endless belt 81 was 0.04 mm.

Comparative Example 2

A fixing apparatus of Comparative Example 2 was used having a similar structure to the fixing apparatus of Example 1 except that the whole thickness of the endless belt 81 was 0.06 mm.

Comparative Example 3

A fixing apparatus of Comparative Example 3 was used having a similar structure to the fixing apparatus of Example 1 except that the whole thickness of the endless belt 81 was 0.15 mm.

Comparative Example 4

A fixing apparatus of Comparative Example 4 was used having a similar structure to the fixing apparatus of Example 1 except that the whole thickness of the endless belt 81 was 0.16 mm.

Experiment Example 1

End cracking and poor rotation were evaluated by the method described below using the image forming apparatuses 1 that were A4-sized machines respectively containing the fixing apparatuses of Examples 1-3 and Comparative Examples 1-4. The results of the evaluations and a comprehensive evaluation are shown in Table 2.

[End Cracking]

After feeding 100,000 A4 size sheets of paper at a copy speed of 40 sheets/minute, a visual check was made as to whether cracking occurred at the ends of the endless belt 81. In the embodiment, the ends of the endless belt 81 are portions of the endless belt 81 which make contact with lateral motion-preventing members mounted at the opposite ends of the endless belt 81.

Good: No end cracking occurred.

Poor: End cracking occurred.

[Poor Rotation]

Poor rotation was confirmed by visually observing how the endless belt turned.

Good: No poor rotation occurred.

Not bad: No poor rotation occurred when the surface temperature of the endless belt 81 was higher than 100° C.

Poor: Poor rotation occurred.

TABLE 2

| | Ex. 1 | Ex. 2 | Ex. 3 | Comp. Ex. 1 | Comp. Ex. 2 | Comp. Ex. 3 | Comp. Ex. 4 |
|---|---|---|---|---|---|---|---|
| Thickness (mm) | 0.08 | 0.10 | 0.14 | 0.04 | 0.06 | 0.15 | 0.16 |
| End cracking | Good | Good | Good | Poor | Poor | Good | Good |
| Poor rotation | Good | Not bad | Not bad | Good | Good | Poor | Poor |
| Comprehensive evaluation | Good | Not bad | Not bad | Poor | Poor | Poor | Poor |

As shown in Table 2, the fixing apparatuses of Examples 1-3 were excellent fixing apparatuses produced neither end cracking nor poor rotation because the thickness of the endless belt 81 was 0.08 mm or more and 0.14 mm or less.

On the other hand, the fixing apparatuses of Comparative Examples 1 and 2 were unpractical fixing apparatuses which produced no poor rotation because the thickness of the endless belt 81 was less than 0.08 mm but end cracking occurred.

In the fixing apparatuses of Comparative Examples 3 and 4, the thickness of the endless belt 81 was in excess of 0.14 mm and, therefore, no end cracking was produced but poor rotation was produced. The apparatuses were unpractical fixing apparatuses.

Experiment Example 2

With respect to the fixing apparatus of Example 1, the contact area angle θ was varied from 30° to 110°. Variations in the warming-up time were measured by the method described below.

[Warming-Up Time]

The warming-up was effected with the fixing roller 60 kept rotated from the outset, and the time for the fixing roller 60 to reach 180° C. was measured.

Temperature control was exercised in such a manner that the temperature of the surface of the endless belt 81 stood at 220° C. and the temperature of the fixing roller 60 stood at 180° C. The fixing roller 60 is set to rotate at a speed of 220 mm/sec.

Figure 7:
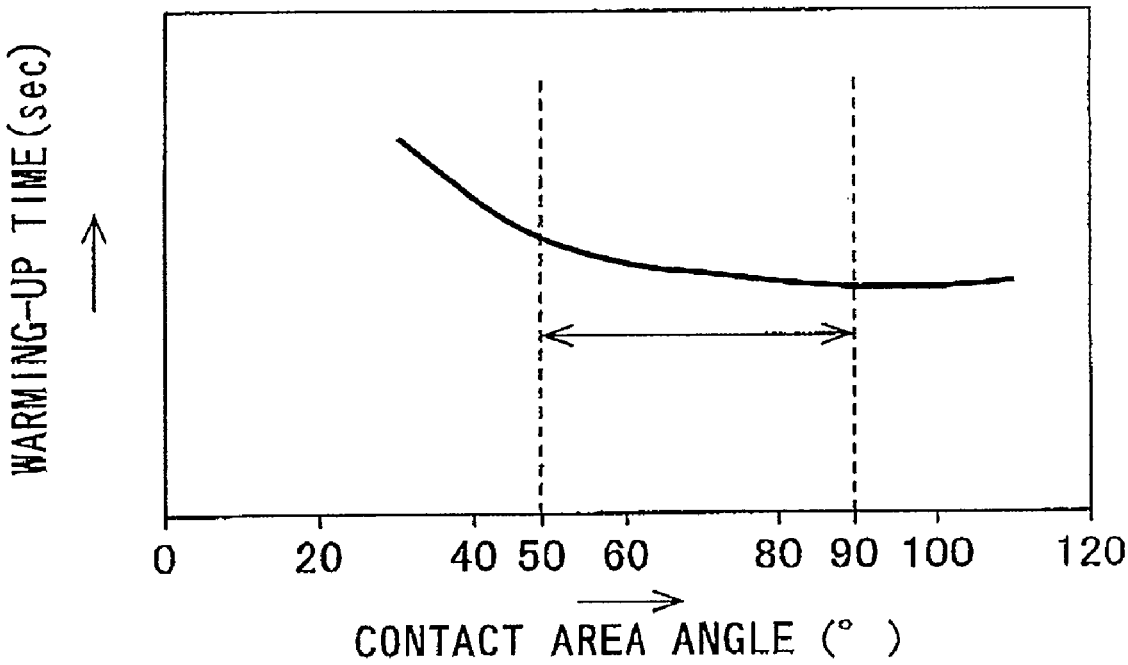
FIG. 7 is a graph showing the relationship between a warming-up time and a contact area angle θ.

The relationship between the warming-up time and the contact area angle θ obtained by the above-described measurements is shown in the graph of FIG. 7.

As shown in FIG. 7, where the contact area angle θ was 50° or more and 90° or less, the warming-up time could be shortened efficiently.

On the other hand, where the contact area angle θ was less than 50°, the amount of heat was not easily moved from the endless belt 81 to the fixing roller 60 and so the warming-up time was prolonged.

Where the contact area angle θ was in excess of 90°, the warming-up time was slightly longer than where the contact area angle θ was 50° or more and 90° or less.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A fixing apparatus comprising:

a pair of fixing sections pressed against each other and including a fixing roller having a first heat-generating portion incorporated therein, and a pressure roller;

an endless belt for heating a surface of the fixing roller by bringing a heating nip portion into contact with the fixing roller;

a plurality of support rollers supporting the endless belt therearound so as to give tension, and each having a second heat-generating portion incorporated therein; and a control unit which controls amounts of heat generated by the first and second heat-generating portions, wherein the endless belt has a thickness of 0.08 mm or more and 0.14 mm or less, and the heating nip portion is formed in an angular range of 50° or more and 90° or less around a center axis of the fixing roller, and wherein, in a warming-up operation, the control unit controls the amounts of heat generated by the first and second heat-generating portions such that, before a surface temperature of the endless belt reaches a first preset temperature, a surface temperature of the fixing roller reaches a second preset temperature.

2. The fixing apparatus of claim 1, wherein each of the support rollers has a support roller body in a form of a hollow cylinder and the support roller body includes a first portion corresponding to a paper passage portion and second portions corresponding to paper non-passage portions, the second portions being located at longitudinal sides of the first portion, a thickness of longitudinal both end portions of the first portion is smaller than that of a longitudinal intermediate portion thereof, and a thickness of the second portions is equal to or greater than that of the longitudinal intermediate portion of the first portion.

3. The fixing apparatus of claim 1, wherein each of the second heat-generating portions produces an amount of heat of 3,000 W/m or less, and a total amount of heat generated by the second heat-generating portions is 1,700 W/m or more.

4. An image forming apparatus equipped with the fixing apparatus of claim 1.

5. A fixing apparatus comprising:

a pair of fixing sections pressed against each other and including a fixing roller having a first heat-generating portion incorporated therein, and a pressure roller;

an endless belt for heating a surface of the fixing roller by bringing a heating nip portion into contact with the fixing roller;

a plurality of support rollers supporting the endless belt therearound so as to give tension, and each having a second heat-generating portion incorporated therein; and a control unit which controls amounts of heat generated by the first and second heat-generating portions, wherein, in a ready-operation in which temperatures of the first and second heat-generating portions are maintained at predetermined preset temperatures and operations of the fixing roller, pressure roller and plurality of support rollers are ceased, the control unit controls the amounts of heat generated by the first and second heat-generating portions such that the surface temperature of the endless belt is equal to or higher than a same temperature as the surface temperature of the fixing roller and is not more than a temperature which is higher than the surface temperature of the fixing roller by 10° C.

6. An image forming apparatus equipped with the fixing apparatus of claim 5.

* * * * *